US008011955B1

(12) United States Patent
Lu

(10) Patent No.: US 8,011,955 B1
(45) Date of Patent: Sep. 6, 2011

(54) COAXIAL CABLE CONNECTOR

(76) Inventor: Yueh Chiung Lu, Tao Yuan Hsien (TW)

( * ) Notice: Subject to any disclaimer, the term of this patent is extended or adjusted under 35 U.S.C. 154(b) by 0 days.

(21) Appl. No.: 13/015,572

(22) Filed: Jan. 27, 2011

(51) Int. Cl.
*H01R 9/05* (2006.01)

(52) U.S. Cl. ..... 439/585

(58) Field of Classification Search ..... 439/585, 439/584

See application file for complete search history.

(56) References Cited

U.S. PATENT DOCUMENTS 6,848,939 B2 2/2005 Stirling
7,458,849 B2 * 12/2008 Rodrigues et al. ..... 439/578
7,544,094 B1 * 6/2009 Paglia et al. ..... 439/585
7,566,236 B2 * 7/2009 Malloy et al. ..... 439/321

* cited by examiner

*Primary Examiner* — Phuong Dinh
(74) *Attorney, Agent, or Firm* — Guice Patents PLLC

(57) ABSTRACT

A coaxial cable connector suitable for assembly with one of a series of coaxial cables having one same specification and different wire outer diameters is disclosed to use a plastic bushing for compressing by a barrel to wrap about the coaxial cable and compress an inner tube against the aluminum foil and insulation spacer of the coaxial cable, protecting the coaxial cable against weather and extending the lifespan. A short distance is left between the aluminum foil insertion hole on the left end of the inner tube and the left orifice of the barrel, facilitating insertion of the insulation spacer and aluminum foil of the coaxial cable without causing damage.

12 Claims, 10 Drawing Sheets

COAXIAL CABLE CONNECTOR

BACKGROUND OF THE INVENTION

1. Field of the Invention

The present invention is coaxial cable connectors and more particularly to such a coaxial cable connector that fits a series of coaxial cables having one same specification and different wire outer diameters.

2. Description of the Related Art

In current television market, cable TV is the mainstream. Cable TV signal is transmitted to a television of a subscriber through a coaxial cable. Coaxial cable is not limited to cable TV application, it can also be used in any of a variety of other fields for signal transmission. For two-way high-frequency transmission, a coaxial cable is extended from an outdoor place to the inside of a house and then connected to a TV or TV splitter through a coaxial cable connector. This coaxial cable connector is adapted for connecting a coaxial cable to a mating connector at the TV or TV splitter.

To fit different signal transmission quality requirements, the braided outer conductor of a coaxial cable can have a standard, tri-shield or quad-shield design. In consequence, the wire outer diameter is relatively changed. Further, a coaxial cable further comprises an aluminum foil surrounding the insulation spacer within the braided outer conductor to provide a shielding effect.

Many coaxial cable connectors are commercially available for assembly with one of a series of coaxial cables having different wire outer diameters. FIG. 1 illustrates a cable end connector A fastened to one end of a coaxial cable B. This cable end connector A consists of a screw nut A1, a plastic body shell A2, an inner tube A3 and a metal barrel A4.

The screw nut A1 is disposed at the front side, having an inner thread for threading onto a mating connector. The plastic body shell A2 is connected to the screw nut A1. A gasket ring A21 is set in between the plastic body shell A2 and the screw nut A1. The inner tube A3 is inserted into the inside of the plastic body shell A2. The metal barrel A4 is sleeved onto one end of the plastic body shell A2 adjacent to the coaxial cable B.

During installation, as shown in FIG. 1, the protective plastic covering of the coaxial cable B is properly stripped off, and then the center conductor B1 of the coaxial cable B is inserted through the metal barrel A4 into the inner tube A3, and then a crimping tool is operated to crimp the cable end connector A, forcing the metal barrel A4 along the plastic body shell A2 toward the screw nut A1, thereby finishing the installation, as shown in FIG. 1A. At this time, a sufficient space is left between the outer edge of the barbed end portion A31 of the inner tube A3 and the inner end edge A23 of the plastic body shell A2 for receiving one of a series of coaxial cables having one same specification and different wire outer diameters. By means of the elastically deformable property of a specially configured packing portion A22 of the plastic body shell A2, a coaxial cable B having a different wire outer diameter can be tightly sealed in this cable end connector A. With respect to the details of this cable end connector, please refer to U.S. Pat. No. 6,848,939, entitled "Coaxial cable connector with integral grip bushing for cables of varying thickness".

However, when the aforesaid cable end connector A is assembled with a coaxial cable B, the plastic body shell A2 is partially exposed to the weather (see FIG. 1A) and will become aged and oxidized soon. Therefore, the application of this design of cable end connector is limited. In actual application, this design of cable end connector still has drawbacks as follows:

1. The plastic body shell A2 is partially exposed to the outside between the screw nut A1 and the metal barrel A4. When the cable end connector A is used outdoor, the plastic body shell A2 will become aged and oxidized soon under the effect of the sun, rain and wind, and rainwater may leak in between the cable end connector A and the coaxial cable B, affecting signal transmission stability and quality. If a metal body shell is used to substitute for the plastic body shell A2, the crimping operation during installation of the cable end connector will become difficult. Therefore, this design of cable end connector is not well invited in the market.

2. A long distance is left between the aluminum foil insertion hole A32 on the left end of the inner tube A3 and the left orifice A41 of the metal barrel A4. This distance is approximately equal to the length of the bare aluminum foil B31 of the coaxial cable B (or even longer), as shown in FIG. 1. Thus, it is difficult to insert the insulation spacer B2 and aluminum foil B3 of the coaxial cable B into the cable end connector A, and the insulation spacer B2 and aluminum foil B3 of the coaxial cable B may be damaged during insertion, affecting signal transmission quality and stability. To avoid this problem, it is necessary to shorten the distance between the aluminum foil insertion hole A32 on the left end of the inner tube A3 and the left orifice A41 of the metal barrel A4 to about ⅔ of the length of the bare aluminum foil B31 of the coaxial cable B. In this case, the inner diameter of the inner end edge A23 of the plastic body shell A2 will be reduced due to engagement between of the clamping portion A22 of the plastic body shell A2 and the beveled clamping surface A42 of the metal barrel A4, interfering with the insertion of the coaxial cable B.

FIG. 2 illustrates another structure of connector D according to the prior art, which consists of a screw nut D1, an inner tube D2, a body shell D3, a barrel D4 and a plastic bushing D5. Unlike the prior art design shown in FIG. 1, the plastic bushing D5 is mounted in the body shell D3 and the barrel D4 and kept from sight.

The screw nut D1 is connected with one end of the inner tube D2 for the passing of the center conductor B1 of the coaxial cable B. The body shell D3 surrounds the inner tube D2. The inner tube D2 has a barbed portion D21 disposed at one end thereof and extending out of one end of the clamping portion D31 of the body shell D3. The barrel D4 is sleeved onto the clamping portion D31 of the body shell D3. The plastic bushing D5 is set in the barrel D4.

A large space is left between the outer edge D211 of the barbed portion D21 of the body inner tube D2 and an inner end edge D51 of the plastic bushing D5 for receiving a different thickness of braided outer conductor of a coaxial cable of one same specification. By means of the elastically deformable property of the plastic bushing D5, the connector fits cables of varying thickness.

In the aforesaid cable end connector D, the body shell D3 is a metal member, and a crimping tool must be used to crimp the clamping portion D31 of the body shell D3 and the barrel D4 during installation of the cable end connector D. Because the crimping distance D32 has a certain length, much crimping pressure must be applied to the crimping tool to move he barrel D4 relative to the clamping portion D31 subject to the crimping distance D32. Thus, much effort is necessary to complete the crimping operation. Further, a long distance is left between the aluminum foil insertion hole D2 on the left end of the inner tube D2 and the left orifice D41 of the metal barrel D4. This distance is greater than the length of the bare aluminum foil B31 of the coaxial cable B. Thus, it is difficult to insert the insulation spacer B2 and aluminum foil B3 of the coaxial cable B into the cable end connector D, and the insulation spacer B2 and aluminum foil B3 of the coaxial cable B may be damaged during insertion. During a high-frequency two-way signal transmission operation, this aluminum foil damage causes an increase in the reflective loss, affecting signal transmission quality and stability. To avoid this problem, it is necessary to shorten the distance between the aluminum foil insertion hole D2 on the left end of the inner tube D2 and the left orifice D41 of the metal barrel D4 to about ⅔ of the length of the bare aluminum foil B31 of the coaxial cable B. In this case, the inner diameter of the inner end edge D51 of the plastic bushing D5 will be reduced due to engagement between of the clamping portion D52 of the plastic bushing D5 and the beveled clamping surface D33 of the body shell D3, interfering with the insertion of the coaxial cable B.

SUMMARY OF THE INVENTION

The present invention has been accomplished under the circumstances in view. It is therefore the main object of the present invention to provide a coaxial cable connector assembled with a coaxial cable consisting of a center conductor, surrounded by an insulation spacer, surrounded by an aluminum foil, surrounded by a braided outer conductor, surrounded by a protective plastic covering. The protective plastic covering of the coaxial cable been stripped off subject to a predetermined length to expose the braided outer conductor, the exposed braided outer conductor been turned backwardly onto the protective plastic covering to expose the insulation spacer and the aluminum foil and to leave a predetermined length of the bare aluminum foil outside the protective plastic covering for installation in the coaxial cable connector. The coaxial cable connector comprises a screw nut having an inner thread for threading onto an outer thread of a mating member; an inner tube mounted in one end of the screw nut, the inner tube comprising a barbed unit extending around the periphery of a left end thereof remote from the screw nut and a foil insertion hole defined in the left end; a body shell surrounding the inner tube, the body shell comprising an axial hole, a clamping portion surrounding the axial hole and a stop flange extending around the periphery at one end of the clamping portion; a barrel sleeved onto one end of the body shell beyond the clamping portion and defining with the body shell a crimping distance before installation of the coaxial cable in the coaxial cable connector, the barrel comprising a left orifice for entrance of the coaxial cable connector, a packing hole defined therein and a tapered inner surface formed in a right side of the packing hole; and a plastic bushing set in the barrel to leave a large gap in between an inner end edge of a left end thereof and an outer end edge of the barbed unit of the inner tube for receiving the braided outer conductor of the coaxial cable, the plastic bushing been crimped and clamped on the protective plastic covering of the coaxial cable against the barbed unit of the inner tube after stoppage of a right end thereof against the stop flange of the body shell, the plastic bushing comprising an inner end edge at a left end thereof, the inner end edge of the plastic bushing defining an inner diameter fitting the packing hole of the barrel, a tapered inside wall gradually reducing in direction from a hole in a right end thereof toward the inner end edge of the left end thereof, and a beveled retaining surface extending around the periphery corresponding to the tapered inside wall and sloping leftwards. The crimping distance is about ⅔ of the predetermined length of the bare aluminum foil of the coaxial cable facilitating crimping. The distance between the aluminum foil insertion hole of the inner tube and the left orifice of the barrel is about ⅔ of the predetermined length of the bare aluminum foil of the coaxial cable; the beveled retaining surface of the plastic bushing is press-fitted into the tapered inner surface of the barrel to prohibit the plastic bushing from escaping from the packing hole of the barrel. The hole in the right end of the plastic bushing is greater than the packing hole of the barrel, capable for receiving a different thickness of braided outer conductor of a coaxial cable of one same specification.

Thus, the coaxial cable connector of the invention has connector that has advantages and features as follows:

1. The crimping distance between the coaxial cable and the coaxial cable is about ⅔ of the predetermined length of bare aluminum foil of the coaxial cable, facilitating crimping.

2. A short distance, about ⅔ of the predetermined length of bare aluminum foil of the coaxial cable is left between the aluminum foil insertion hole 2 on the left end of the inner tube and the left orifice of the barrel, facilitating insertion of the insulation spacer and aluminum foil of the coaxial cable without causing damage.

3. The plastic bushing has a beveled retaining surface press-fitted into the tapered inner surface of the barrel so that the plastic bushing will not escape from the packing hole of the barrel.

4. The hole in the right end of the plastic bushing is greater than the packing hole of the barrel, capable for receiving a different thickness of braided outer conductor of a coaxial cable of one same specification.

5. By means of the elastically deformable feature of the hole in the right end of the plastic bushing to compress the barbed portions of the inner tube, the part of the coaxial cable outside the barbed portions of the inner tube well wrapped, achieving a watertight seal.

6. The inner diameter of the inner end edge of the left end of the plastic bushing fits the packing hole of the barrel for guiding in the coaxial cable.

7. The plastic bushing further has a tapered inside wall gradually reducing in direction from the hole in the right end toward the inner end edge of the left end.

DETAILED DESCRIPTION OF THE PREFERRED EMBODIMENT

Figure 1:
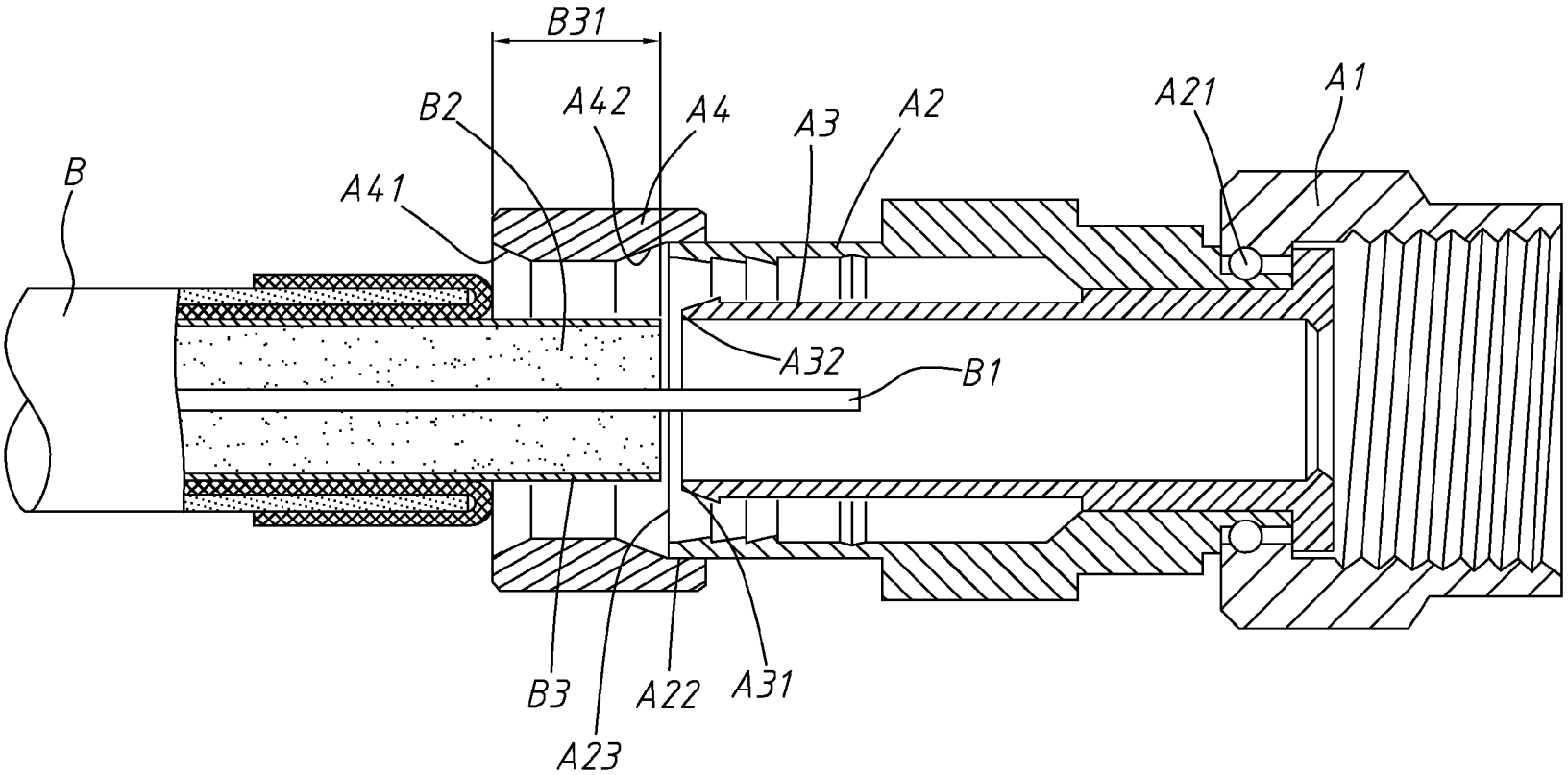
FIG. 1 Prior Art
FIG. 1 is a sectional view of a coaxial cable connector before installation of a coaxial cable according to the prior art.
Figure 1A:
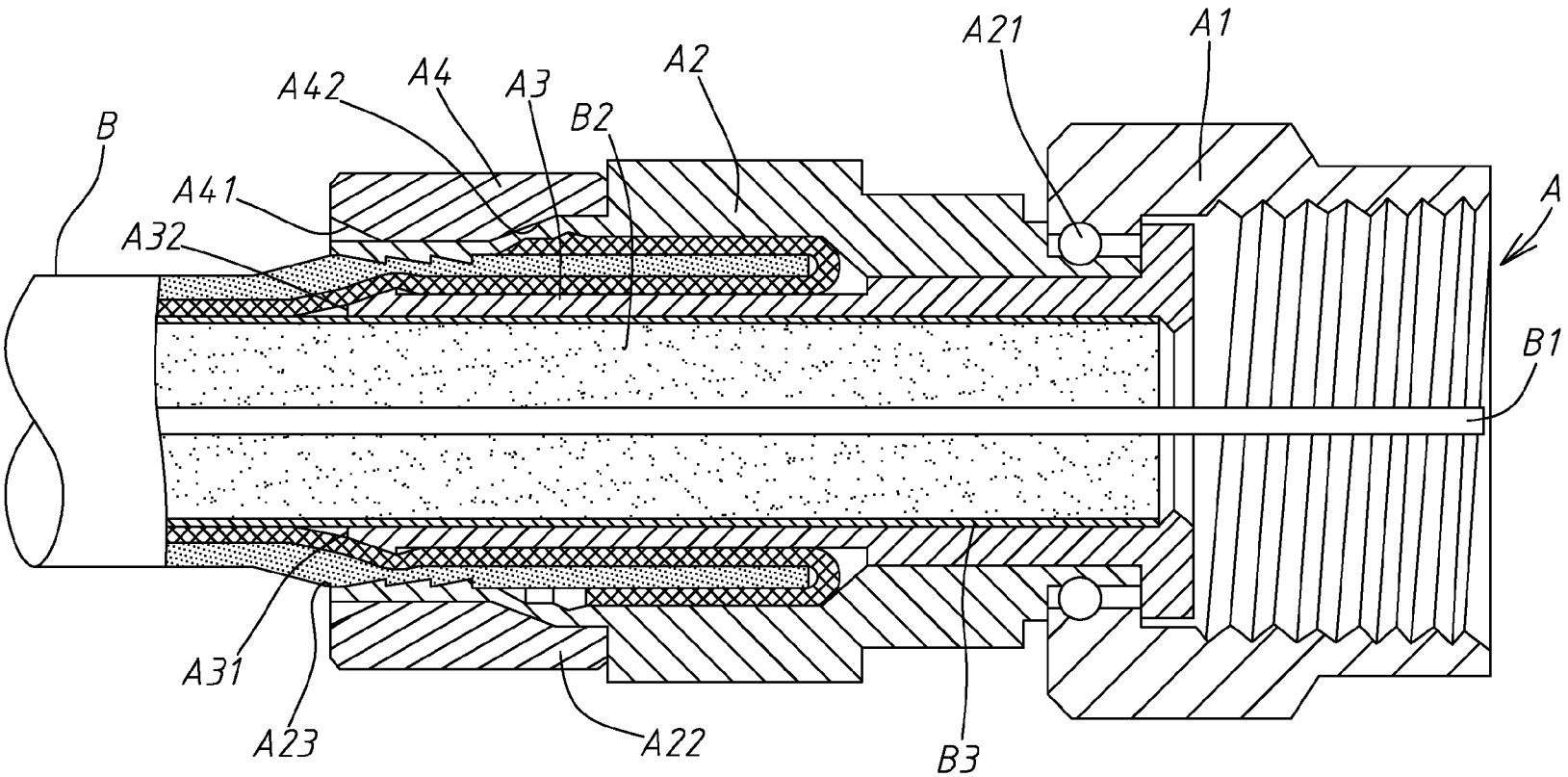
FIG. 1A Prior Art
FIG. 1A is similar to FIG. 1, illustrating a coaxial cable installed in the coaxial cable connector.
Figure 2:
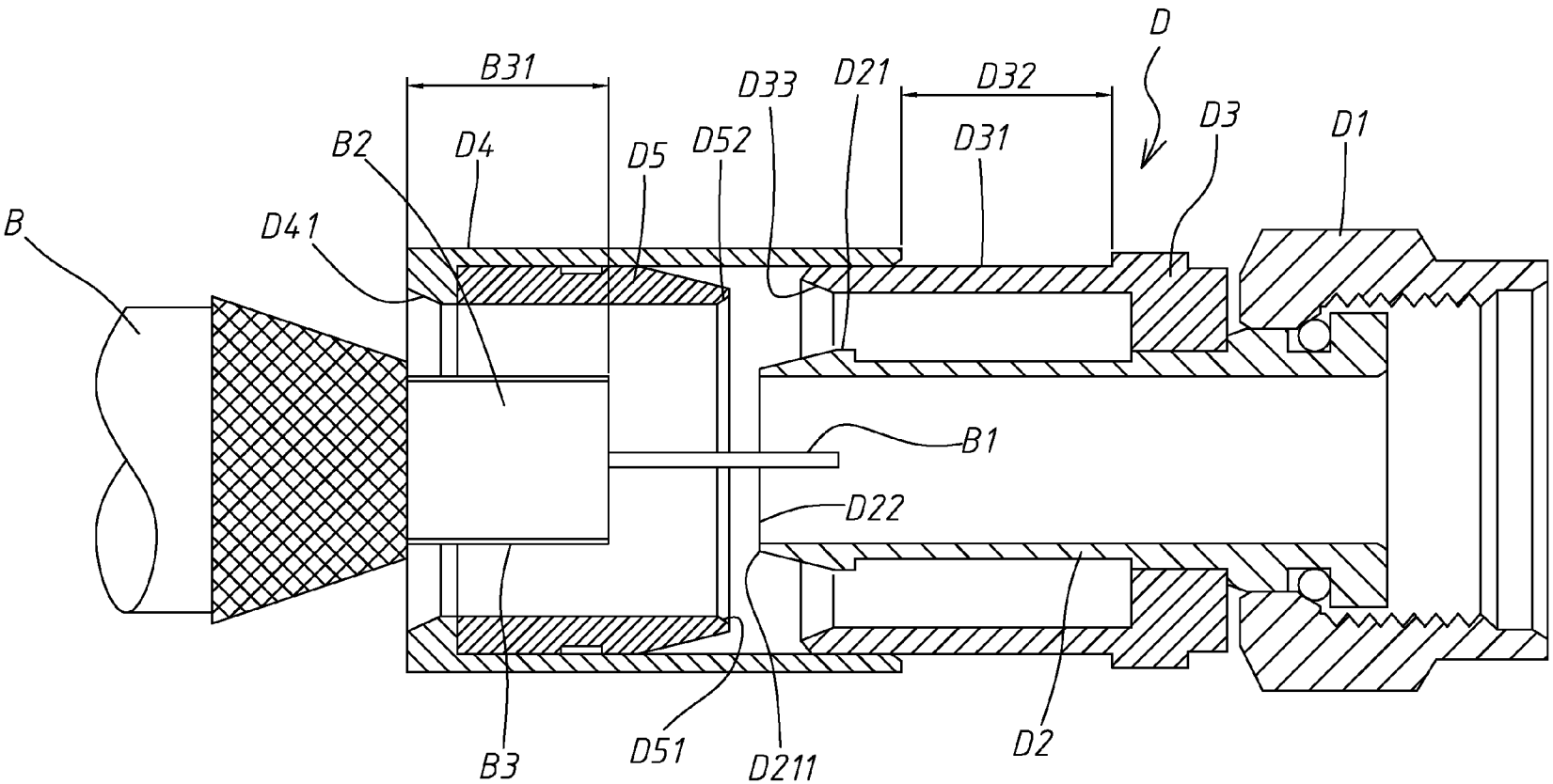
FIG. 2 Prior Art
FIG. 2 is a sectional view of another structure of coaxial cable according to the prior art.
Figure 3:
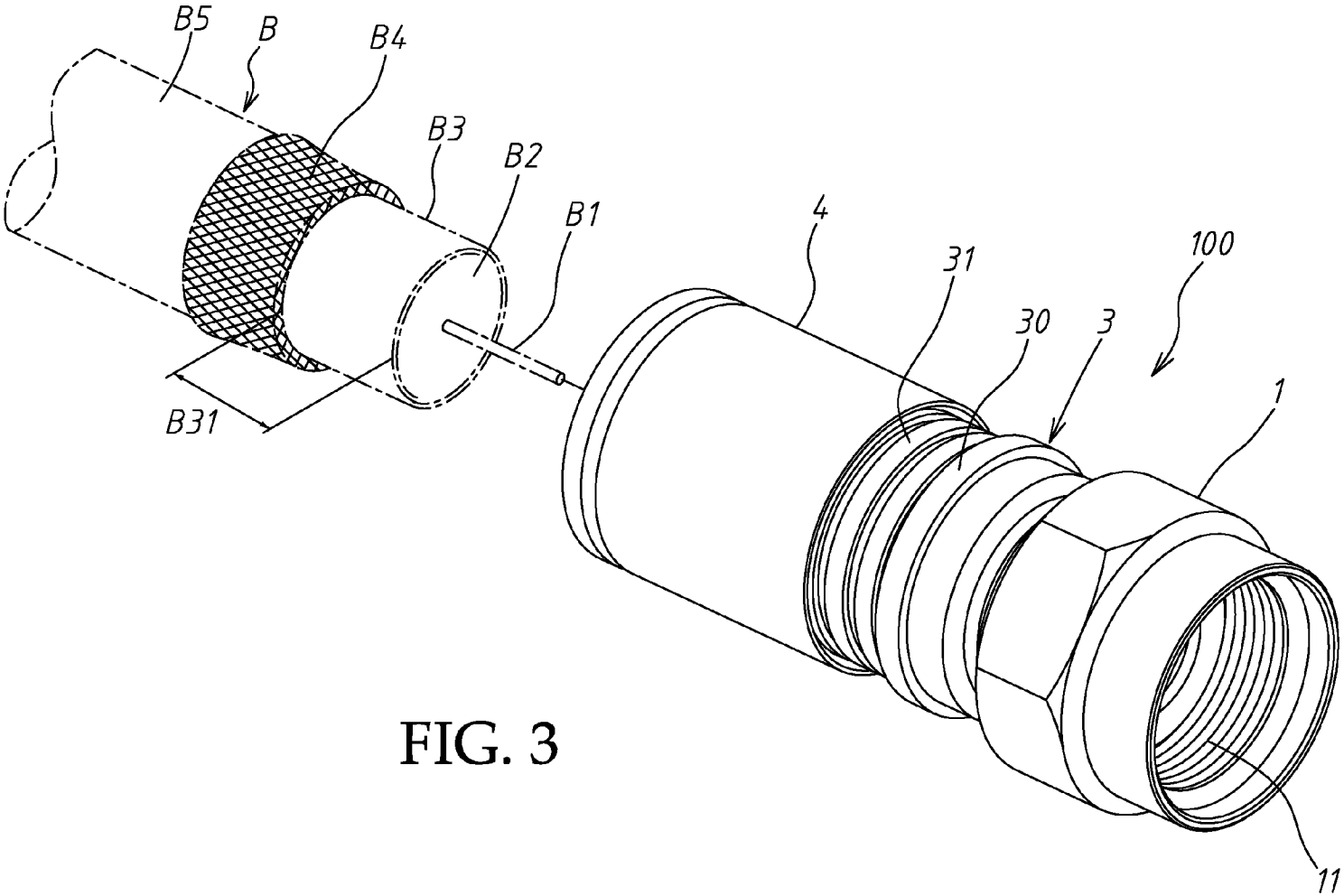
FIG. 3 is an elevational assembly view of a coaxial cable connector in accordance with the present invention.
Figure 4:
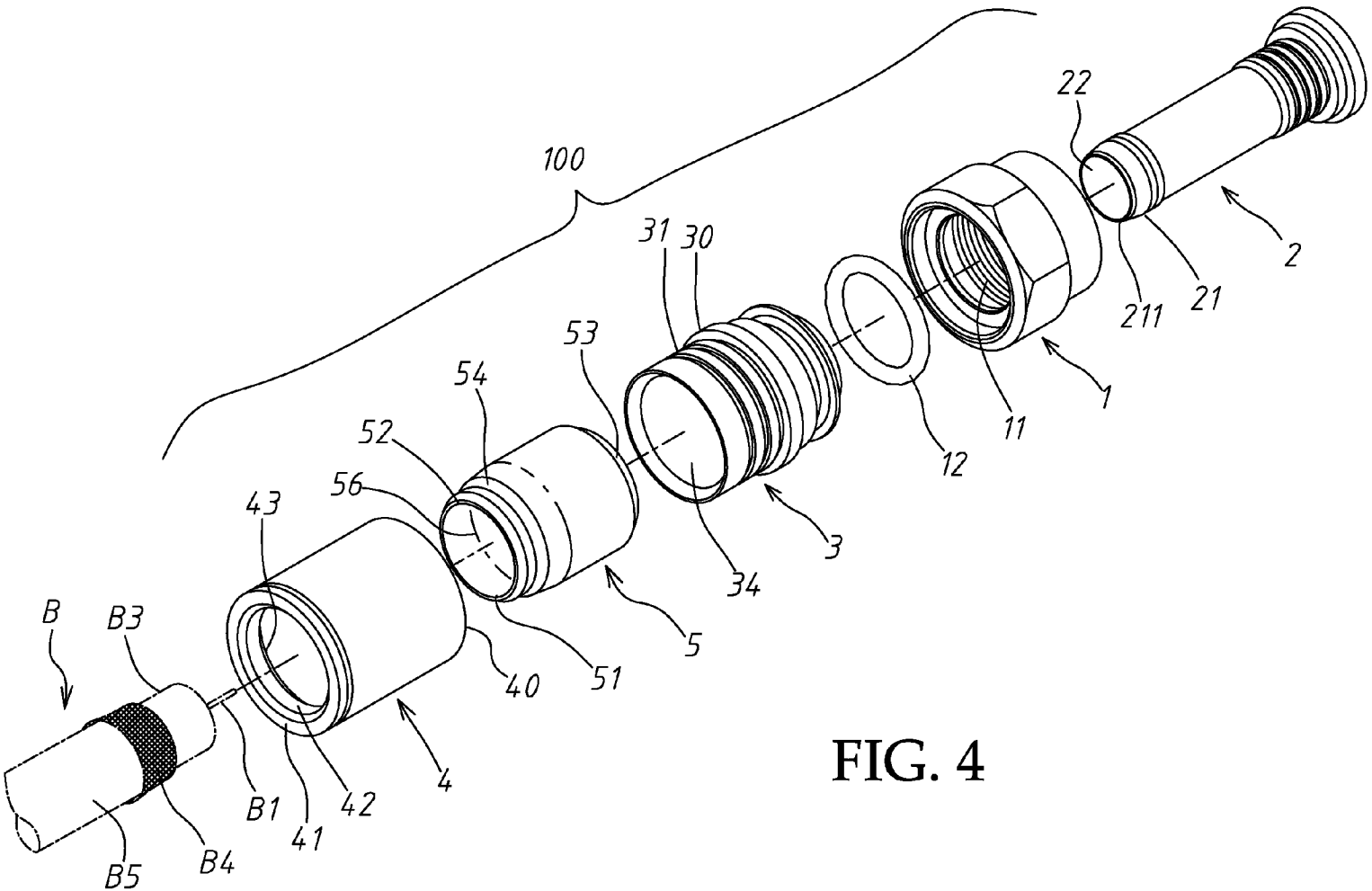
FIG. 4 is an exploded view of the coaxial cable connector in accordance with the present invention.
Figure 5:
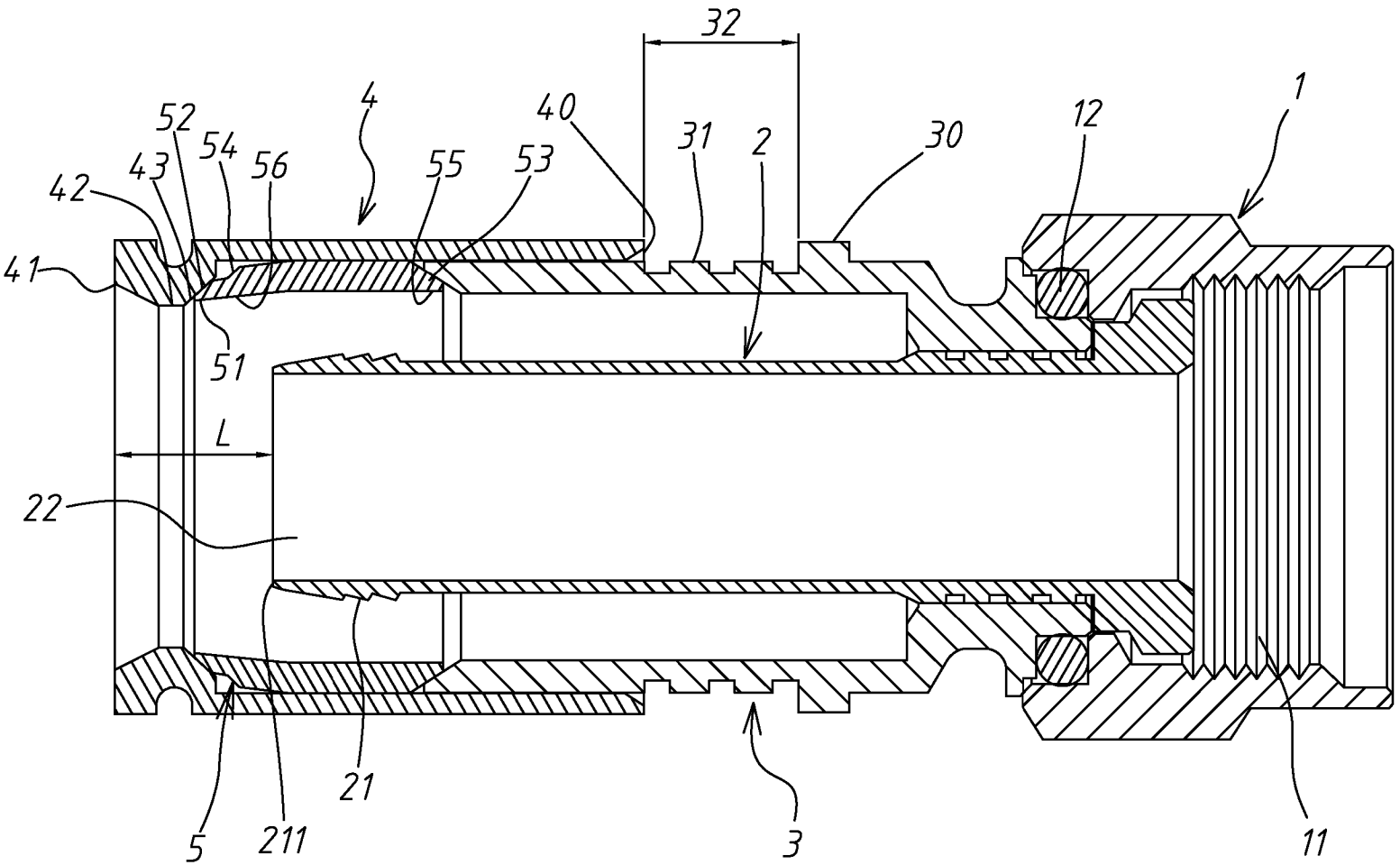
FIG. 5 is a sectional view of the coaxial cable connector in accordance with the present invention.

Referring to FIGS. 3~5, a coaxial cable connector 100 in accordance with the present invention is shown comprising a screw nut 1, an inner tube 2, a body shell 3, a barrel 4 and a plastic bushing 5.

The coaxial cable connector 100 is assembled with a coaxial cable B consisting of a center conductor B1, surrounded by an insulation spacer B2, surrounded by an aluminum foil B3, surrounded by a braided outer conductor B4, surrounded by a protective plastic covering B5. The braided outer conductor B4 can be a standard, tri-shield or quad-shield design.

Referring to FIG. 5 again, the screw nut 1 has an inner thread 11 for threading onto an outer thread of a mating member (not shown); the inner tube 2 is mounted in one end of the screw nut 1; the body shell 3 surrounds the inner tube 2, having a clamping portion 31 and a stop flange 30 extending around the periphery at one end of the clamping portion 31; the inner tube 2 has a barbed unit formed of at least one, for example, three barbed portions 21 (as shown in FIG. 5) suspending outside the body shell 3. Further, a gasket ring 12 is mounted in between the screw nut 1 and the body shell 3.

The barrel 4 is sleeved onto one end of the body shell 3 beyond the clamping portion 31. The plastic bushing 5 is set in the barrel 4, leaving a large gap in between the inner end edge 51 of the left end 52 of the plastic bushing 5 and the outer end edge 211 of the barbed portions 21 of the inner tube 2 for receiving the braided outer conductor B4 (of standard, tri-shield or quad-shield design) of the coaxial cable B, see also FIG. 9. By means of the elastically deformable material property, the protective plastic covering B5 cab be positively surrounded by the plastic bushing 5 to compress the barbed portions 21 of the inner tube 2, enhancing engagement between the barbed portions 21 of the inner tube 2 and the braided outer conductor B4 of the coaxial cable B and sealing the gap against outside moisture.

Referring to FIGS. 4 and 5 again, the inner end edge 51 of the left end 52 of the plastic bushing 5 has a diameter fitting the inner diameter of the packing hole, referenced by 42, of the barrel 4. The inner end edge 51 of the left end 52 of the plastic bushing 5 has an inner diameter fitting the packing hole 42 of the barrel 4. The plastic bushing 5 further has a tapered inside wall 56 gradually reducing in direction from the hole 55 in the right end 53 toward the inner end edge 51 of the left end 52, and a beveled retaining surface 54 extending around the periphery corresponding to the tapered inside wall 56 and sloping leftwards. Further, a crimping distance 32 is defined between the body shell 3 and the barrel 4, i.e., between an inner end edge 40 of the barrel 4 and the stop flange 30 of the .body shell 3.

FIGS. 6~9 illustrate the assembly process of the coaxial cable B and the coaxial cable connector 100.

Figure 6:
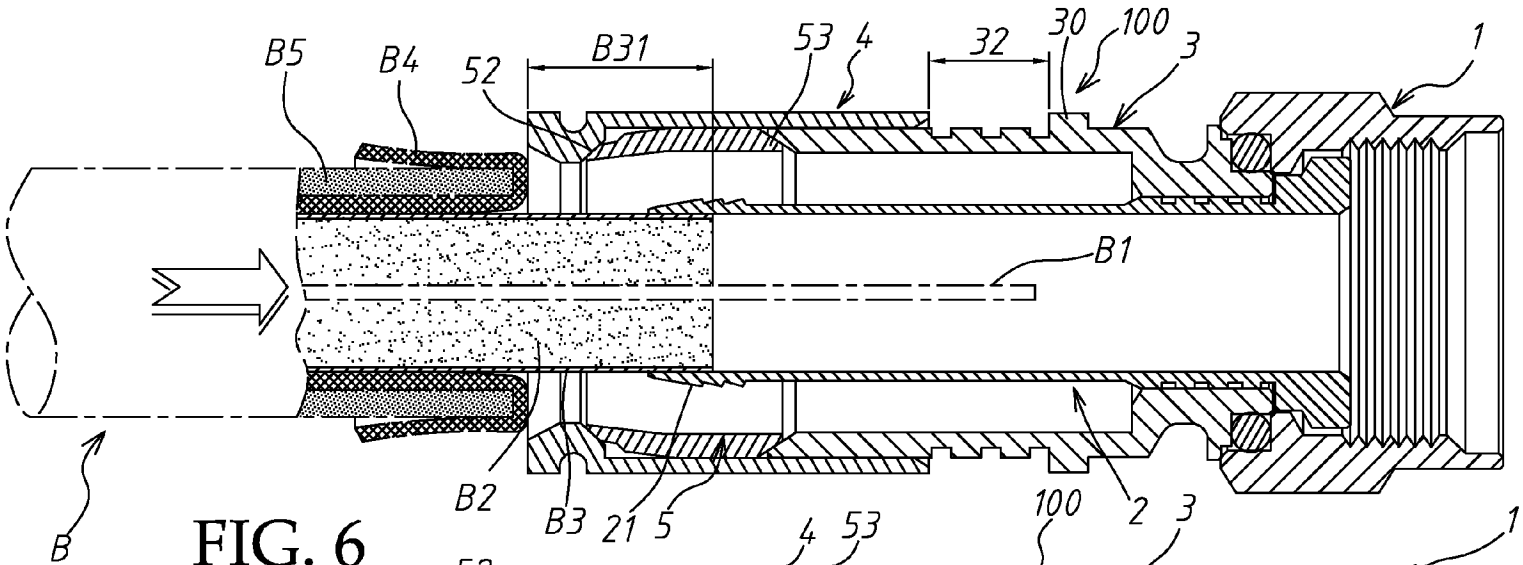
FIGS. 6~9 illustrate the assembly process of the coaxial cable connector with a coaxial cable according to the present invention.

At first, as shown in FIG. 6, strip off the protective plastic covering B5 of the coaxial cable B properly, and then turn the exposed braided outer conductor B4 backwardly onto the protective plastic covering B5 to expose the insulation spacer B2 and the aluminum foil B3, leaving a predetermined length of bare aluminum foil B31 outside the protective plastic covering B5. Normally, the predetermined length of bare aluminum foil B31 is ¼ inches (6.4 mm). At this time, the crimping distance 32 defined between the body shell 3 and the barrel 4 is maintained. The crimping distance 32 is ⅔ of the predetermined length of bare aluminum foil B31.

Figure 7:
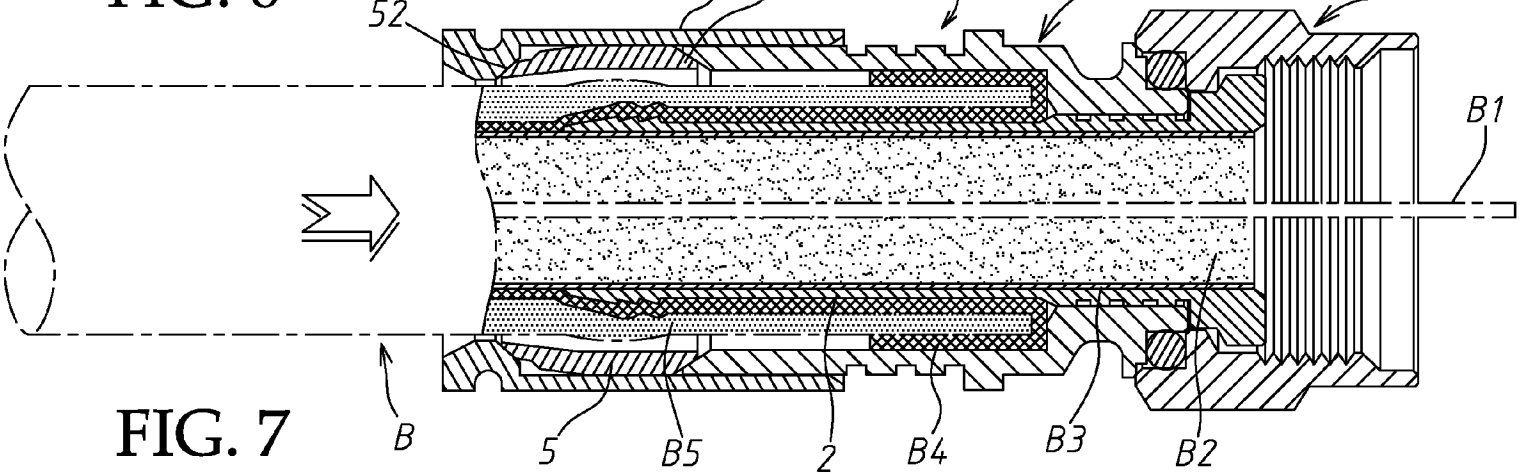

Thereafter, as shown in FIG. 7, insert the coaxial cable B into the coaxial connector 100. At this time, the coaxial cable B and the coaxial connector 100 are not crimped by a crimping tool. As illustrated, the center conductor B1 of the coaxial cable B passes through the barrel 4 and the plastic bushing 5 into the inner tube 2 and extends out of the screw nut 1, the insulation spacer B2 and aluminum foil B3 of the coaxial cable B are inserted into the inside of the inner tube 2, and the inner tube 2 is inserted in between the aluminum foil B3 and the braided outer conductor B4 of the coaxial cable B.

Figure 8:
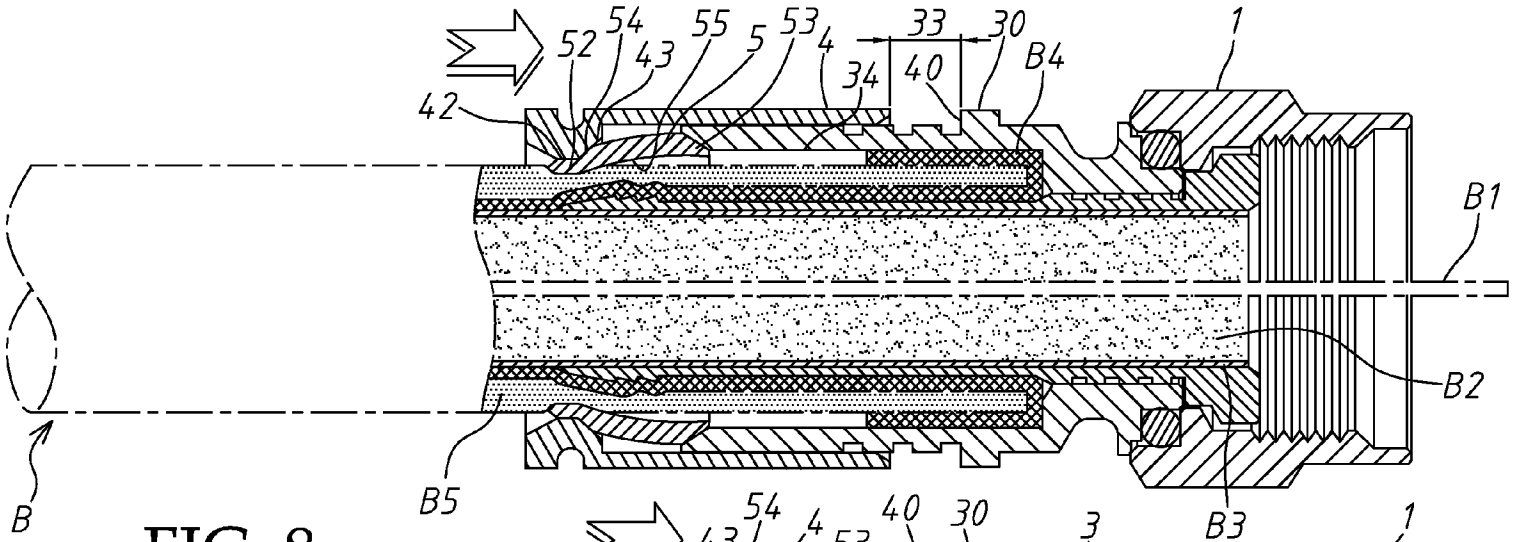

Thereafter, as shown in FIG. 8, after insertion of the coaxial cable B into the coaxial cable connector 100, a crimping tool is used to crimp the coaxial cable connector 100. When the crimping distance 32 is reduced to ½ distance 33 during crimping, the inner end edge 51 of the left end 52 of the plastic bushing 5 will be forced to compress the coaxial cable B and to guide the barrel 4 toward the screw nut 1 (see the arrowhead direction), causing the left end 52 of the plastic bushing 5 to enter the packing hole 42 of the barrel 4 subject to the guidance of a tapered inner surface 43 in the barrel 4, and to force the beveled retaining surface 54 of the left end 52 of the plastic bushing 5 into engagement with the tapered inner surface 43 of the barrel 4.

Figure 9:
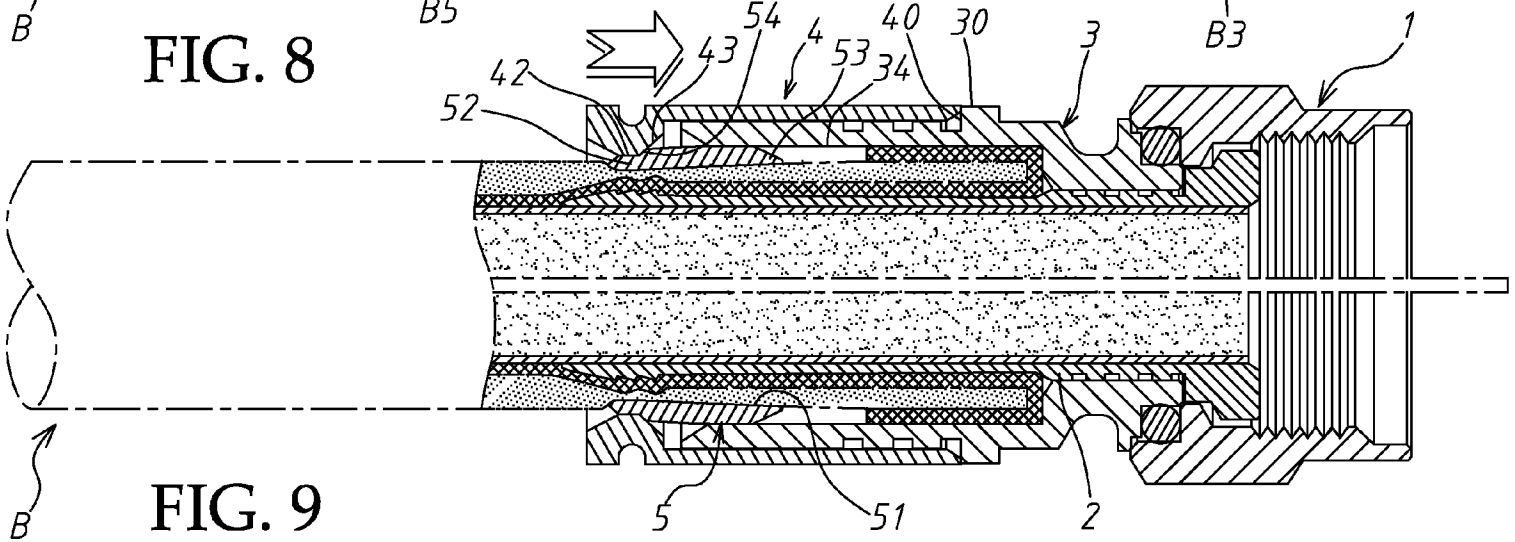

When the crimping tool is crimped to the extent, the crimping distance 32 is disappeared, as shown in FIG. 9. At this time, the inner end edge 40 of the barrel 4 is stopped against the stop flange 30 of the .body shell 3, and the right end 53 of the plastic bushing 5 is tightly engaged in the axial hole 34 of the body shell 3. FIG. 9 illustrates the coaxial cable B inserted into the coaxial cable connector 100 and crimped.

In the aforesaid coaxial cable connector 100, the body shell 3 is made of a metal material (plastics can also be used). Because both the body shell 3 and the barrel 4 are metal members, the crimping distance 32 can be relatively shorter so that less effort is necessary when crimping the clamping portion 31 of the body shell 3 and the barrel 4 by the crimping tool. The crimping distance 32 is preferably about ⅔ of the predetermined length of bare aluminum foil B31 of the coaxial cable B.

Further, a short distance L is left between the aluminum foil insertion hole 22 in the left end of the inner tube 2 and the left orifice 41 of the barrel 4 (see FIG. 5). This short distance L is about ⅔ of the predetermined length of bare aluminum foil B31 of the coaxial cable B. This short distance L facilitates insertion of the insulation spacer B2 and aluminum foil B3 of the coaxial cable B without causing damage. When used for high-frequency two-way signal transmission application, the reflective loss is minimized, enhancing transmission quality and stability.

In conclusion, the invention provides a coaxial cable connector that has advantages and features as follows:

1. The crimping distance 32 between the coaxial cable B and the coaxial cable 100 is about ⅔ of the predetermined length of bare aluminum foil B31 of the coaxial cable B, facilitating crimping.

2. A short distance, about ⅔ of the predetermined length of bare aluminum foil B31 of the coaxial cable B is left between the aluminum foil insertion hole 22 on the left end of the inner tube 2 and the left orifice 41 of the barrel 4, facilitating insertion of the insulation spacer B2 and aluminum foil B3 of the coaxial cable B without causing damage.

3. The plastic bushing 5 has a beveled retaining surface 54 press-fitted into the tapered inner surface 43 of the barrel 4 so that the plastic bushing 5 will not escape from the packing hole 42 of the barrel 4.

4. The hole 55 in the right end 53 of the plastic bushing 5 is greater than the packing hole 42 of the barrel 4, capable for receiving a different thickness of braided outer conductor B4 of a coaxial cable B of one same specification.

5. By means of the elastically deformable feature of the hole 55 in the right end 53 of the plastic bushing 5 to compress the barbed portions 21 of the inner tube 2, the part of the coaxial cable B outside the barbed portions 21 of the inner tube 2 is well wrapped, achieving a watertight seal.

6. The inner diameter of the inner end edge 51 of the left end 52 of the plastic bushing 5 fits the packing hole 42 of the barrel 4 for guiding in the coaxial cable B.

7. The plastic bushing 5 further has a tapered inside wall 56 gradually reducing in direction from the hole 55 in the right end 53 toward the inner end edge 51 of the left end 52.

Figure 10:
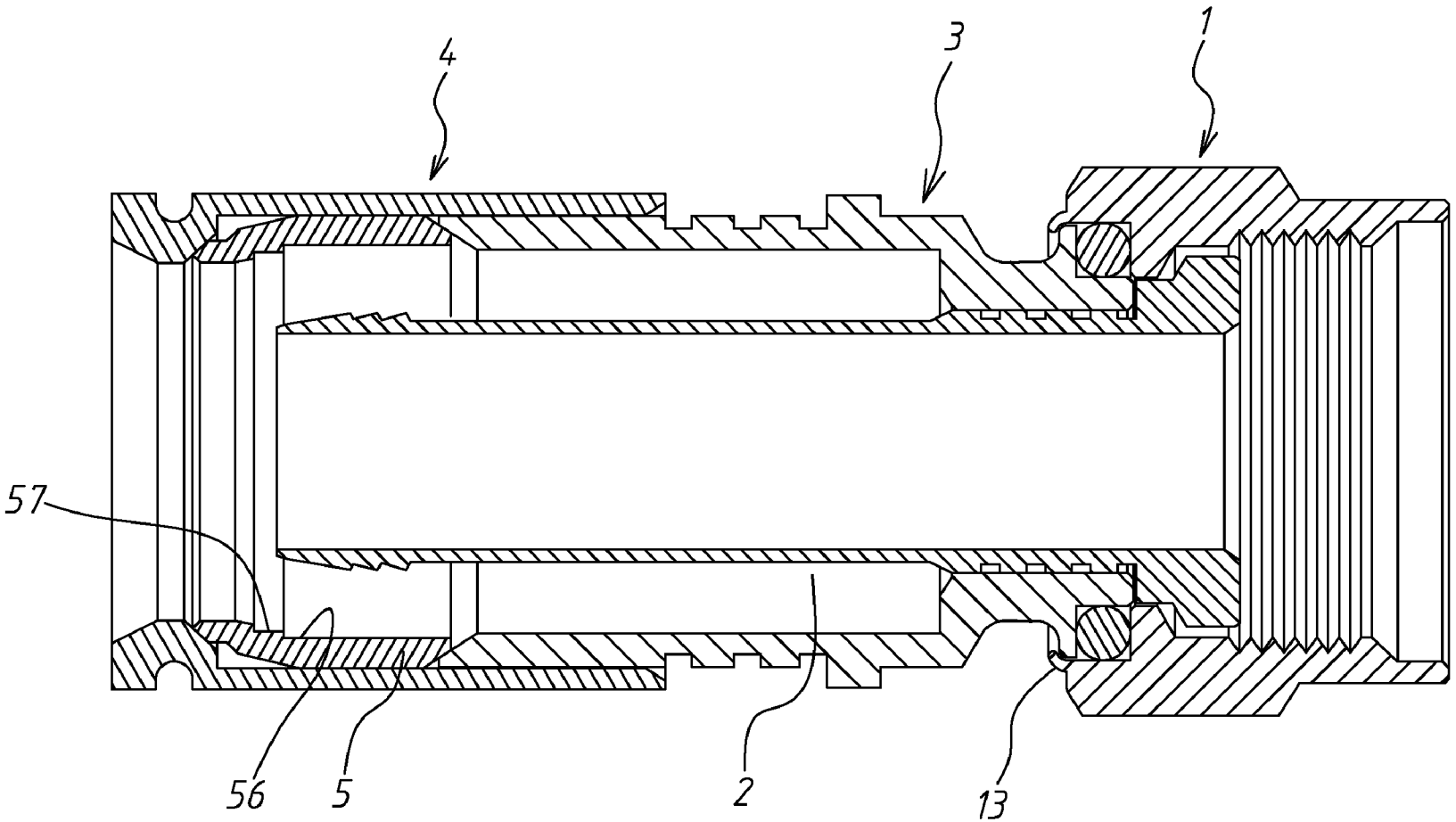
FIG. 10 is a sectional view of an alternate form of the coaxial cable connector in accordance with the present invention.

FIG. 10 illustrates an alternate form of the coaxial cable connector in accordance with the present invention. Similarly, this alternate form comprises a screw nut 1, an inner tube 2, a body shell 3, a barrel 4 and a plastic bushing 5. According to this alternate form, the plastic bushing 5 further comprises a barbed portion 57 extending around the tapered inside wall 56 for retaining the inserted coaxial cable B tightly; the screw nut 1 further has a constructed end portion 13, enhancing the shielding effect of the coaxial cable connector.

Figure 11:
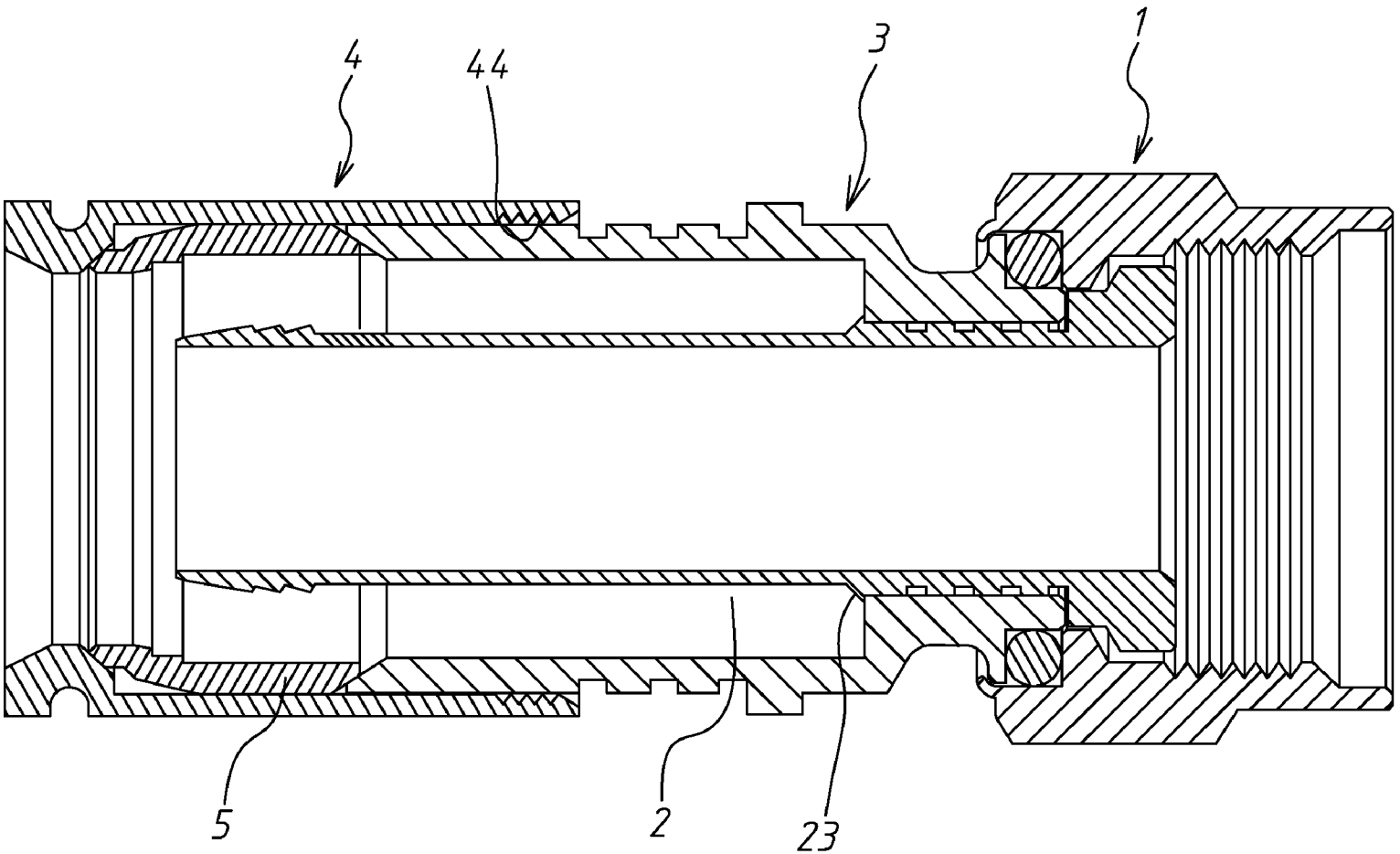
FIG. 11 is a sectional view of another alternate form of the coaxial cable connector in accordance with the present invention.

FIG. 11 illustrates another alternate form of the coaxial cable connector in accordance with the present invention. Similarly, this alternate form comprises a screw nut 1, an inner tube 2, a body shell 3, a barrel 4 and a plastic bushing 5. According to this alternate form, the body shell 3 is a plastic member; the barrel 4 has an inner thread 44 forced into engagement with the periphery of the body shell 3 to enhance connection between the body shell 3 and the barrel 4 and to prohibit the body shell 3 from escaping from the barrel 4; the inner tube 2 further comprises a barbed portion 23 for stopping against a constructed inner part of the body shell 3 to prohibit the body shell 3 from escaping from the inner tube 2.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A coaxial cable connector assembled with a coaxial cable consisting of a center conductor, surrounded by an insulation spacer, surrounded by an aluminum foil, surrounded by a braided outer conductor, surrounded by a protective plastic covering, said protective plastic covering of said coaxial cable been stripped off subject to a predetermined length to expose said braided outer conductor, the exposed braided outer conductor been turned backwardly onto said protective plastic covering to expose said insulation spacer and said aluminum foil and to leave a predetermined length of the bare aluminum foil outside said protective plastic covering for installation in said coaxial cable connector, said coaxial cable connector comprising:

a screw nut having an inner thread for threading onto an outer thread of a mating member;

an inner tube mounted in one end of said screw nut, said inner tube comprising a barbed unit extending around the periphery of a left end thereof remote from said screw nut and a foil insertion hole defined in the left end;

a body shell surrounding said inner tube, said body shell comprising an axial hole, a clamping portion surrounding said axial hole and a stop flange extending around the periphery at one end of said clamping portion;

a barrel sleeved onto one end of said body shell beyond said clamping portion and defining with said body shell a crimping distance before installation of said coaxial cable in said coaxial cable connector, said barrel comprising a left orifice for entrance of said coaxial cable connector, a packing hole defined therein and a tapered inner surface formed in a right side of said packing hole; and a plastic bushing set in said barrel to leave a large gap in between an inner end edge of a left end thereof and an outer end edge of the barbed unit of said inner tube for receiving said braided outer conductor of said coaxial cable, said plastic bushing been crimped and clamped on said protective plastic covering of said coaxial cable against said barbed unit of said inner tube after stoppage of a right end thereof against said stop flange of said body shell, said plastic bushing comprising an inner end edge at a left end thereof, the inner end edge of said plastic bushing defining an inner diameter fitting the packing hole of said barrel, a tapered inside wall gradually reducing in direction from a hole in a right end thereof toward the inner end edge of the left end thereof, and a beveled retaining surface extending around the periphery corresponding to said tapered inside wall and sloping leftwards;

wherein said crimping distance is about ⅔ of the predetermined length of the bare aluminum foil of said coaxial cable facilitating crimping; the distance between the aluminum foil insertion hole of said inner tube and the left orifice of said barrel is about ⅔ of the predetermined length of the bare aluminum foil of said coaxial cable; said beveled retaining surface of said plastic bushing is press-fitted into said tapered inner surface of said barrel to prohibit said plastic bushing from escaping from said packing hole of said barrel; the hole in the right end of said plastic bushing is greater than the packing hole of said barrel, capable for receiving a different thickness of braided outer conductor of a coaxial cable of one same specification.

2. The coaxial cable connector as claimed in claim 1, further comprising a gasket ring mounted in between said screw nut and said body shell.

3. The coaxial cable connector as claimed in claim 1, wherein said crimping distance is the distance between the inner end edge of said barrel and the stop flange of said body shell.

4. The coaxial cable connector as claimed in claim 1, wherein said barbed unit comprises at least one barbed portion.

5. The coaxial cable connector as claimed in claim 1, wherein said plastic bushing is elastically deformable.

6. The coaxial cable connector as claimed in claim 1, wherein said crimping distance is equal to the distance between the aluminum foil insertion hole of said inner tube and the left orifice of said barrel.

7. The coaxial cable connector as claimed in claim 1, wherein said plastic bushing further comprises a barbed portion extending around the tapered inside wall thereof.

8. The coaxial cable connector as claimed in claim 1, wherein said screw nut comprises constructed end portion at one end thereof.

9. The coaxial cable connector as claimed in claim 1, wherein said body shell is a metal member.

10. The coaxial cable connector as claimed in claim 1, wherein said body shell is a plastic member.

11. The coaxial cable connector as claimed in claim 10, wherein said body shell comprises an inner thread forced into engagement with the periphery of said body shell to enhance connection between said body shell and said barrel and to prohibit said body shell from escaping from said barrel.

12. The coaxial cable connector as claimed in claim 10, wherein said inner tube further comprises a barbed portion adapted for stopping against a constructed inner part of said body shell to prohibit said body shell from escaping from said inner tube.

* * * * *